US011053563B2

(12) United States Patent
Bai et al.

(10) Patent No.: US 11,053,563 B2
(45) Date of Patent: Jul. 6, 2021

(54) X80 PIPELINE STEEL WITH GOOD STRAIN-AGING PERFORMANCE, PIPELINE TUBE AND METHOD FOR PRODUCING SAME

(71) Applicant: BAOSHAN IRON & STEEL CO., LTD., Shanghai (CN)

(72) Inventors: Mingzhuo Bai, Shanghai (CN); Lei Zheng, Shanghai (CN); Leilei Sun, Shanghai (CN); Guodong Xu, Shanghai (CN); Kougen Wu, Shanghai (CN); Haisheng Xu, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 483 days.

(21) Appl. No.: 15/559,048

(22) PCT Filed: Sep. 16, 2015

(86) PCT No.: PCT/CN2015/089696
§ 371 (c)(1),
(2) Date: Sep. 17, 2017

(87) PCT Pub. No.: WO2016/150116
PCT Pub. Date: Sep. 29, 2016

(65) Prior Publication Data

US 2018/0073094 A1 Mar. 15, 2018

(30) Foreign Application Priority Data

Mar. 20, 2015 (CN) ..... 201510125587.3

(51) Int. Cl.
*C22C 38/50* (2006.01)
*C22C 38/48* (2006.01)
(Continued)

(52) U.S. Cl.
CPC ..... *C21D 9/08* (2013.01); *B21B 1/026* (2013.01); *B21B 1/04* (2013.01); *B21B 1/463* (2013.01); *B21B 45/0203* (2013.01); *C21D 1/18* (2013.01); *C21D 6/004* (2013.01); *C21D 6/005* (2013.01); *C21D 6/008* (2013.01); *C21D 8/10* (2013.01); *C21D 8/105* (2013.01); *C22C 38/001* (2013.01);
(Continued)

(58) Field of Classification Search
None
See application file for complete search history.

(56) References Cited

FOREIGN PATENT DOCUMENTS

CN 101456034 A 6/2009
CN 101845596 A 9/2010
(Continued)

OTHER PUBLICATIONS

Machine translation of JP2002-220634A. (Year: 2002).*
(Continued)

*Primary Examiner* — Xiaowei Su
(74) *Attorney, Agent, or Firm* — Thomas Horstemeyer, LLP

(57) ABSTRACT

A X80 pipeline steel with good strain-aging performance comprises (wt. %): C: 0.02-0.05%; Mn: 1.30-1.70%; Ni: 0.35-0.60%: Ti: 0.005-0.020%; Nb: 0.06-0.09%; Si: 0.10-0.30%; Al: 0.01-0.04%; N≤0.008%; P≤0.012%; S≤0.006%; Ca: 0.001-0.003%, and balance iron and unavoidable impurities.

13 Claims, 1 Drawing Sheet

(51) Int. Cl.

| | |
|---|---|
| ***C22C 38/06*** | (2006.01) |
| ***C22C 38/58*** | (2006.01) |
| ***C21D 9/08*** | (2006.01) |
| ***C21D 8/10*** | (2006.01) |
| ***C21D 6/00*** | (2006.01) |
| ***C21D 1/18*** | (2006.01) |
| ***C22C 38/14*** | (2006.01) |
| ***B21B 1/02*** | (2006.01) |
| ***B21B 1/04*** | (2006.01) |
| ***B21B 1/46*** | (2006.01) |
| ***B21B 45/02*** | (2006.01) |
| ***C22C 38/00*** | (2006.01) |
| ***C22C 38/02*** | (2006.01) |

(52) U.S. Cl.

CPC ..... *C22C 38/002* (2013.01); *C22C 38/02* (2013.01); *C22C 38/06* (2013.01); *C22C 38/14* (2013.01); *C22C 38/48* (2013.01); *C22C 38/50* (2013.01); *C22C 38/58* (2013.01); *B21B 2001/028* (2013.01); *C21D 2211/002* (2013.01); *C21D 2211/005* (2013.01)

(56) References Cited

FOREIGN PATENT DOCUMENTS

| | | | | |
|---|---|---|---|---|
| CN | 103981462 | A | | 8/2014 |
| CN | 104789863 | A | | 7/2015 |
| CN | 104805375 | A | | 7/2015 |
| JP | 2002220634 | A | * | 8/2002 |
| JP | 2004043911 | A | | 2/2004 |
| KR | 20090070484 | A | * | 7/2009 |
| KR | 20120071619 | A | | 7/2012 |

OTHER PUBLICATIONS

Machine translation of KR10-2009-0070484. (Year: 2009).*
PCT/CN2015/089696 International Search Report and Written Opinion, dated Dec. 25, 2015.

* cited by examiner

X80 PIPELINE STEEL WITH GOOD STRAIN-AGING PERFORMANCE, PIPELINE TUBE AND METHOD FOR PRODUCING SAME

CROSS-REFERENCE TO RELATED APPLICATIONS

This application is a 371 U.S. National Phase of PCT International Application No. PCT/CN2015/089696, filed on Sep. 16, 2015, which claims benefit and priority to Chinese patent application No. 201510125587.3, filed on Mar. 20, 2015. Both of the above-referenced applications are incorporated by reference herein in their entirety.

TECHNICAL FIELD

The present invention relates to a steel material, and particularly relates to a pipeline steel. The present invention relates to a line pipe made of the pipeline steel and a manufacturing method for the line pipe.

BACKGROUND ART

Since the temperature in an extremely cold area is very low, a line pipe used in such an area needs to have a good low temperature toughness, for example, the pipe has to pass a drop weight tear test (DWTT) at −45° C. so as to meet ductile fracture requirements at extremely low temperatures. Moreover, since there are permafrost zones in extremely cold areas, the ground surface may rise and fall as the climate changes, pipes buried in such areas usually need to be designed according to the strains of the pipes; that is to say, pipes in such areas must have good strain resistance.

In the process of pipeline production, a steel pipe is manufactured from a steel plate first through cold forming, and then hot-coated with an anti-corrosion coating. The coating process is generally carried out at 180-250° C. for 5-10 min, and in this process, strain aging may occur, i.e., solute elements in the steel are easily diffused and interact with dislocations to form Cottrell atmospheric pin dislocations, resulting in reduced toughness and ductility of the steel; therefore, strain aging may change the performance of the steel pipe, and results in the reduced anti-strain capacity of the steel plate. In this regard, line pipes of strain-based designs in frozen earth areas should further have good anti-strain aging ability.

Chinese patent document with Publication No. CN 101611163 A, published on Dec. 23, 2009, entitled "low yield ratio dual phase steel line pipe with superior strain aging resistance", discloses a dual phase steel line pipe. The dual phase steel line pipe disclosed in the patent document comprises (in percentage by mass): 0.05-0.12% carbon, 0.005-0.03% niobium, 0.005-0.02% titanium, 0.001-0.01% nitrogen, 0.01-0.5% silicon, 0.5-2.0% manganese, and less than 0.15% of the total of molybdenum, chromium, vanadium and copper. The dual phase steel comprises a first phase composed of ferrite and a second phase comprising one or more components selected from carbides, pearlite, martensite, lower bainite, granular bainite, upper bainite and degenerate upper bainite. The content in percentage by mass of solute carbon in the first phase is about 0.01% or less. However, the dual phase steel disclosed in the above-mentioned Chinese patent document neither relates to a large strain resistance under requirements of strain-based designs, nor does it have a DWTT property meeting anti-extremely low temperature fracture toughness requirements.

There is a Chinese patent document with Publication No. CN 103572025 A, published on Feb. 12, 2014, entitled "method for producing low-cost X52 pipeline steel and pipeline steel". This patent document discloses an anti-strain aging pipeline steel and its manufacturing method. The manufacturing method comprises subjecting molten iron to desulphurization, converter smelting and continuous casting to form a pipeline steel continuous casting slab, and further comprises soaking said pipeline steel continuous casting slab to 1160-1200° C., subjecting said pipeline steel continuous casting slab to 3-7 passes of rough rolling using a rough rolling mill to obtain an intermediate slab, subjecting the intermediate slab to 4-7 passes of finishing rolling using a finishing rolling mill, finally rapidly cooling the finishing-rolled pipeline steel to 550-610° C. at a cooling rate of 50-100° C./s, and coiling same to obtain a finished pipeline steel product.

SUMMARY OF THE INVENTION

An objective of the present invention lies in providing an X80 pipeline steel with good strain-aging resistance, which has an excellent low temperature fracture toughness resistance, an excellent large deformation resistance of strain-based designs and a good strain-aging resistance.

In order to achieve the above-mentioned objective, the present invention provides an X80 pipeline steel with good strain-aging resistance, and the contents in percentage by mass chemical elements are:

0.02-0.05% of C,
1.30-1.70% of Mn,
0.35-0.60% of Ni,
0.005-0.020% of Ti,
0.06-0.09% of Nb,
0.10-0.30% of Si,
0.01-0.04% of Al,
N≤0.008%,
P≤0.012%,
S≤0.006%,
0.001-0.003% of Ca, and the balance being Fe and other inevitable impurities.

The principle of the design of the chemical elements in the X80 pipeline steel with good strain-aging resistance of the present invention is as follows:

Carbon: C element as an interstitial atom solid-dissolved in steel can have the function of solid solution strengthening. Carbides formed from C element can further have the function of precipitation strengthening. However, in this technical solution, an excessively high content of C may adversely affect the toughness and weldability of steel. In order to ensure an excellent low temperature toughness, the content of C in the X80 pipeline steel of the present invention should be controlled in a range of 0.02-0.05%.

Manganese: Mn is a basic alloy element in low alloy high strength steels, can improve the strength of a steel by means of solid solution strengthening, and can also compensate for a strength loss caused by a reduced content of C in the steel. Mn is also a γ phase-expanding element, and can reduce the γ→α phase-transformation temperature of steel, facilitating the steel plate to obtain a fine phase transformation product during cooling, thereby improving the toughness of the steel. Therefore, in the technical solution of the present invention, the content in percentage by mass of Mn needs to be controlled at 1.30-1.70%.

Nickel: Ni is an important toughening element. The addition of a certain amount of Ni element can improve the strength of steel, and more importantly, Ni can further reduce the ductile-brittle transition temperature point of steel, thereby improving the toughness of the steel under low temperature conditions. In this regard, the content of Ni in the X80 pipeline steel of the present invention is defined to 0.35-0.60%.

Titanium: Ti is an important microalloy element. Ti can be combined with a free-state N element in molten steel to form TiN; moreover, Ti can further form carbonitrides of Ti in solid phase steel to hinder the growth of austenite grains, which is beneficial to structure refining. Exactly for this reason, Ti element can improve the impact toughness of welding heat affected zone of steel, and is conducive to the weldability of the steel. However, an excessively high content of Ti can increase the solid solubility product of titanium carbonitride, such that precipitated particles are coarsened and thus are disadvantageous for structure refining. Thus, based on the technical solution of the present invention, the content of Ti needs to be controlled at 0.005-0.020%.

Niobium: Nb can significantly improve the recrystallization ending temperature of steel so as to provide a wider range of deformation temperature for non-recrystallization zone rolling, such that the deformed austenite structure is transformed into a finer phase transformation product during phase transformation so as to effectively refine grains, thereby improving the strength and toughness of the steel plate. In an after-rolling cooling stage, Nb is dispersively dispersed in the form of carbonitrides, without losing the toughness of the steel while improving the strength of the steel. Thus, the content in percentage by mass of Nb in the X80 pipeline steel of the present invention is controlled between 0.06% and 0.09%.

Silicon: Si is an essential element for steelmaking deoxidation, and has a certain solid solution strengthening effect in steel. However, an excessively high content of Si can affect the toughness of steel, and worsen the weldability of the steel worse. Based on the technical solution of the present invention, the addition amount of Si in the X80 pipeline steel needs to be controlled at 0.10-0.30%.

Aluminium: Al is a deoxidizing element for steelmaking. In addition, the addition of an appropriate amount of Al is beneficial to refining the grains in steel, thereby improving the toughness of the steel. In view of this, in the technical solution of the present invention, the content of Al element needs to be set to 0.010-0.040%.

Calcium: By way of a treatment with Ca, the morphology of sulphides in steel can be controlled, thereby improving the low temperature toughness of steel. In the technical solution of the present invention, where the Ca content is less than 0.001 wt. %, the Ca cannot function to improve low temperature toughness, and where the Ca content is too high, inclusions of Ca can be increased and the sizes of the inclusions are increased, resulting in a damage to the toughness of the steel. Therefore, the content of Ca in the X80 pipeline steel of the present invention is 0.001-0.003 wt. %.

Nitrogen, phosphorus and sulphur: in the technical solution of the present invention, N, P and S easily form defects such as segregation and inclusions in steel, and in turn deteriorate the weldability, impact toughness and HIC resistance of the pipeline steel. Therefore, these elements are all impurity elements. In order to ensure that the steel plate has good low temperature toughness, the above impurity elements need to be controlled to a relatively low level, wherein N is controlled at ≤0.008%, P is controlled at 0.012% and S is controlled at ≤0.006%.

In the technical solution of the present invention, a C—Mn—Cr—Ni—Nb-based composition design is used, i.e., a composition system of a low content of C in combination with Ni and Nb in a high content. In the design, a low content of C can improve the low temperature toughness of steel pipe, a high content of Ni can further improve the toughness of steel and greatly reduce the ductile-brittle transition temperature of the steel plate while improving the strength of the steel plate. A high content of Nb can improve the recrystallization temperature of the steel, and can form precipitated particles of Nb(C, N), thereby refining the structure, and thus accordingly improving the strength of the steel while improving the toughness of the steel.

Compared with the existing X80 pipeline steels in which Mo element is usually added, no Mo is added in the pipeline steel of the present invention, and the key reason is that although the Mo element in pipeline steel can effectively improve the strength of the steel, the element can also easily form M-A martensite-austenite constituents in the structure of the steel, thus affecting the DWTT performance of the steel under low temperature conditions. The technical solution of the present invention fully compensates for the strength of the steel due to the composition design of high contents of Nb and Ni, such that the X80 pipeline steel of the present invention further has excellent low temperature DWTT performance while ensuring a certain strength.

Further, the X80 pipeline steel with good strain-aging resistance of the present invention further comprises 0<Cr≤0.30 wt. %.

Chromium: Cr is an important strengthening element for alloy steels. With regard to pipeline steel of a thicker specification, Cr element can replace the noble Mo element to improve the hardenability of the steel plate, thus facilitating the steel to obtain a bainite structure that has a higher strength. However, an excessive addition of Cr may be disadvantageous to the weldability and low temperature toughness of the steel. In view of this, a certain content of Cr element can be added to the X80 pipeline steel of the present invention, and the content in percentage by mass needs to be controlled at 0<Cr≤0.30 wt %.

Further, the microstructure of the X80 pipeline steel with good strain-aging resistance of the present invention is polygonal ferrite+acicular ferrite+bainite.

The microstructure of the above-mentioned pipeline steel can be regarded as a "dual phase composite structure", in which the fine polygonal ferrite is a soft phase structure, and the fine acicular ferrite+bainite form a hard phase structure. Therefore, in the deformation of the steel pipe, a process of "soft phase preferentially undergoing plastic deformation→strengthening→stress concentration→hard phase subsequently undergoing plastic deformation" can occur. In this process, deformation concentration that occurs in local regions and so leads to a stability loss of the steel pipe in a force field can be avoided by the continuous yielding of the microstructure of the steel, so as to improve the overall deformation capacity of the steel pipe. Moreover, it is exactly the steel having the above-mentioned microstructure that can meet requirements of strain-based designs in geologic unstable regions such as frozen earth regions, and such a microstructure enable the pipeline steel of the present invention to have an appropriate yield strength, tensile strength and low yield ratio as well as continuous stress-strain curve and a uniform elongation at the same time. Such a microstructure defined in this technical solution is advantageous to enhance the strain resistance of the steel pipe, and the fine polygonal ferrite structure and the fine acicular ferrite structure can divide the bainite structure and prevent the bainite structure from being a continuous ribbon-like coarse tissue, thereby improving the DWTT performance of the steel plate. In the present invention, a composition design of a low content of C combined with a high content of Ni is used, and the above-mentioned "dual phase composite structure" of polygonal ferrite+(acicular ferrite+bainite) can be fully refined, which is a key factor that the pipeline steel of the present invention can still meet DWTT performance SA %≥85% at an extremely low temperature of −45° C.

Furthermore, the phase proportion of the above-mentioned polygonal ferrite (in area ratio) is 25-40%.

Another object of the present invention lies in providing a line pipe made of the X80 pipeline steel with good strain-aging resistance as mentioned hereinabove. Therefore, the pipeline steel also has an excellent low temperature fracture toughness resistance, an excellent large deformation resistance of strain-based designs and a good strain-aging resistance, and is suitable for arrangements in extremely cold areas and frozen earth areas.

Accordingly, the present invention further provides a method for manufacturing the above-mentioned line pipe, comprising the steps of smelting, casting, casting slab heating, staged rolling, delayed rate-varying cooling and pipe making.

Further, in the above-mentioned casting step of the method for manufacturing the pipeline steel of the present invention, continuous casting is used, and the ratio of the thickness of the steel slab after the continuous casting to the thickness of the steel plate after the completion of the staged rolling is ≥10.

In the technical solution of the present invention, a continuous casting process is used for producing the steel slab, and the thickness of the steel slab needs to be ensured such that the ratio of the thickness of the steel slab after the continuous casting to the thickness of the steel plate after the completion of rolling reaches 10 or greater, i.e., $t_{slab}/t_{plate} \geq 10$, whereby each rolling stage in the staged rolling can be ensured to have a sufficient compression ratio, such that the structure of the steel plate is fully refined in the rolling process, thereby improving the toughness of the steel plate. This technical solution does not define the upper limit of the thickness ratio, because the parameter should be as large as possible within the permissible range of the manufacturing process.

Further, in the above-mentioned casting slab heating step of the method for manufacturing the pipeline steel of the present invention, the steel slab is reheated at a T Kelvin temperature, $T=7510/(2.96-\log[Nb][C])+30$, wherein [Nb] and [C] respectively represent the contents in percentage by mass of Nb and C.

Further, in the method for manufacturing the X80 pipeline steel of the present invention, the above-mentioned staged rolling step comprises a first rolling stage and a second rolling stage, and the steel slab is rolled to a thickness of $4t_{plate}-0.4t_{slab}$ in the first rolling stage, wherein $t_{plate}$ represents the thickness of the steel plate after the completion of the rolling step, and $t_{slab}$ represents the thickness of the steel slab after the continuous casting.

The purpose of the staged rolling step comprising the first rolling stage and the second rolling stage is to ensure a sufficient recrystallization refining and non-recrystallization refining, and to ensure the rough rolling compression ratio to be greater than 60%, wherein the thickness of an intermediate slab after the first rolling stage should meet $4t_{plate}-0.4t_{slab}$. In another aspect, the purpose of the control of the intermediate slab thickness after the first rolling stage is to ensure the overall deformation of the second rolling stage, so that the finishing rolling compression ratio is greater than 75%.

Furthermore, in the method for manufacturing the pipeline steel of the present invention, the start rolling temperature of the above-mentioned first rolling stage is 960-1150° C., and the start rolling temperature of the above-mentioned second rolling stage is 740-840° C.

The steel slab is rolled after full austenitization, wherein the first rolling stage is carried out in a recrystallization zone (i.e., rolling at a temperature of 960-1150° C.) and the second rolling stage is carried out in a non-recrystallization zone (i.e., rolling at a temperature of 740-840° C.). The rolling at 740-840° C. is a key factor for the full refinement of non-recrystallized austeniteed. This is also the core technology of the technical solution of the present invention with respect to the existing methods for manufacturing pipeline steels.

It is to be noted that after the completion of the first rolling stage, the intermediate slab can be cooled with cooling water, reducing the temperature-holding time and ensuring the refining effect on the structure of the steel. After uniform self-tempering, the steel slab is subjected to the second rolling stage.

Furthermore, in the method for manufacturing the X80 pipeline steel of the present invention, at least two passes in the above-mentioned first rolling stage have a single pass reduction of ≥15%, and at least two passes in the above-mentioned second rolling stage have a single pass reduction of ≥20%.

In this technical solution, the reason why no upper limit is set for the single pass reductions of at least two passes is that the value should be as large as possible above the lower limit, within the permissible range of the production process.

Furthermore, in the method for manufacturing the pipeline steel of the present invention, the finish rolling temperature of the above-mentioned second rolling stage is Ar3 to Ar3+40° C.

It is to be noted that the start rolling temperature of the second rolling stage is appropriately based on a steel plate rolling pacing that can ensure a minimum temperature of the finish rolling temperature.

Furthermore, in the above-mentioned delayed rate-varying cooling step of the method for manufacturing the pipeline steel of the present invention, the steel plate after the completion of the rolling is first air-cooled and hold for 60-100 s to reach 700-730° C. such that ferrite is precipitated at a phase proportion (in area ratio) of 25-40%.

The purpose of first cooling the rolled steel plate and temperature-holding until the temperature of the steel plate is reduced to 700-730° C. is to allow the steel plate to enter into a dual phase of ferrite+austenite, whereby the ferrite begins to nucleate and precipitate. Since low-temperature high-pressure rolling is used in the second rolling stage, the ferrite nucleated and precipitated in the steel can be very fine, and the distribution of the ferrite is also more dispersed. In the above-mentioned technical solution, after the completion of the second rolling stage, the steel plate is not immediately subjected to ACC water cooling, but is treated in a delayed rate-varying cooling manner, which is also a key point that distinguishes the technical solution of the present invention from the existing methods for manufacturing line pipes.

Furthermore, in the above-mentioned delayed rate-varying cooling step of the method for manufacturing the pipeline steel of the present invention, after the precipitation of the ferrite at a phase proportion of 25-40%, the steel plate is water-cooled rapidly to 550-580° C. at a cooling rate of 25-40° C./s, and then further water-cooled slowly at a cooling rate of 18-22° C. %, with the final cooling temperature being 320-400° C., so as to form the ultimately desired microstructure in the steel, e.g., the remaining austenite can be changed to an acicular ferrite+bainite structure.

Based on the technical solution of the present invention, when the steel plate is rapidly water-cooled to 550-580° C., the ferrite transformation is terminated, and the remaining untransformed austenite can be converted to a fine acicular ferrite+bainite hard phase structure in the subsequent slow cooling process. The reason why the hard phase structure is superior to a complete bainite structure is that the acicular ferrite structure can divide the concentrated ribbon-like distribution of the bainite structure, so as to improve the toughness of the steel plate.

Furthermore, in the above-mentioned pipe making step of the method for manufacturing the pipeline steel of the present invention, the O-moulding compression ratio is controlled at 0.15-0.3%, and the E-moulding diameter expansion ratio is controlled at 0.8-1.2%.

The compression ratio and diameter expansion rate are key technological processes resulting in a change in steel plate performance after the pipe making using the pipeline steel. Since tensile strain can occur to the pipe-making steel plate after a diameter expansion, and this pre-strain can increase the yield strength of the steel and form a large amount of residual stress and dislocations in the steel, the yield ratio of the steel pipe is increased correspondingly while the uniform elongation may be reduced. When the line pipe needs to undergo an anti-corrosion hot coating process, multiplication dislocations in the steel can cause aging of the steel pipe under a Cottrell atmosphere effect produced by the process, i.e., the yield ratio increases substantially while the uniform elongation is further reduced. In addition, the low temperature toughness of the steel is also greatly reduced, and the tensile curve of the steel appears in a yield platform or at the upper or lower yield point, all of which may worsen the anti-strain capacity of the steel. In the pipe making step, the incidence rate of pre-strain after the pipe making using the steel plate is reduced by means of increasing the compression ratio and reducing the diameter expansion ratio, thereby improving the strain-aging resistance of the line pipe.

The X80 pipeline steel with good strain-aging resistance of the present invention has a higher strength and a better toughness; furthermore, the X80 pipeline steel further has a good large deformation resistance and an excellent strain-aging resistance.

Since the microstructure of the X80 pipeline steel with good strain-aging resistance of the present invention is a combined soft-hard phase structure of polygonal ferrite+(acicular ferrite+bainite), the pipeline steel has a good low temperature fracture toughness resistance and can still meet DWTT performance SA %≥85% at an extremely low temperature of −45° C.

The line pipe of the present invention has a higher strength, and the body of the pipe has a circumferential yield strength of 560-650 MPa and a tensile strength of 625-825 MPa, which can meet the stress design requirements of high pressure conveying.

Moreover, the line pipe of the present invention has a good strain-aging resistance, wherein after aging, the longitudinal yield strength reaches 510-630 MPa, the tensile strength can reach 625-770 MPa, the uniform elongation is ≥6%, and the yield ratio is ≤0.85, the tensile curve appears as a dome-shaped continuous yield curve, which can meet the performance requirements of strain-based designs.

Furthermore, the line pipe of the present invention has an excellent low temperature fracture toughness resistance and can still meet DWTT performance SA %≥85% at an extremely low temperature of −45° C., and therefore the line pipe can meet the performance requirements of strain-based designs in frozen earth areas (extremely low temperature regions).

By the method for manufacturing an X80 pipeline steel with good strain-aging resistance of the present invention, a line pipe having a high strength, a good low temperature fracture toughness resistance, an excellent large deformation resistance and an excellent strain-aging resistance can be produced.

DETAILED DESCRIPTION OF EMBODIMENTS

The X80 pipeline steel with good strain-aging resistance, the line pipe and the manufacturing method for the pipe of the present invention are further explained and described below in conjunction with the description of the drawings and specific examples; however, the explanation and description do not constitute an inappropriate limitation to the technical solution of the present invention.

Figure 1:
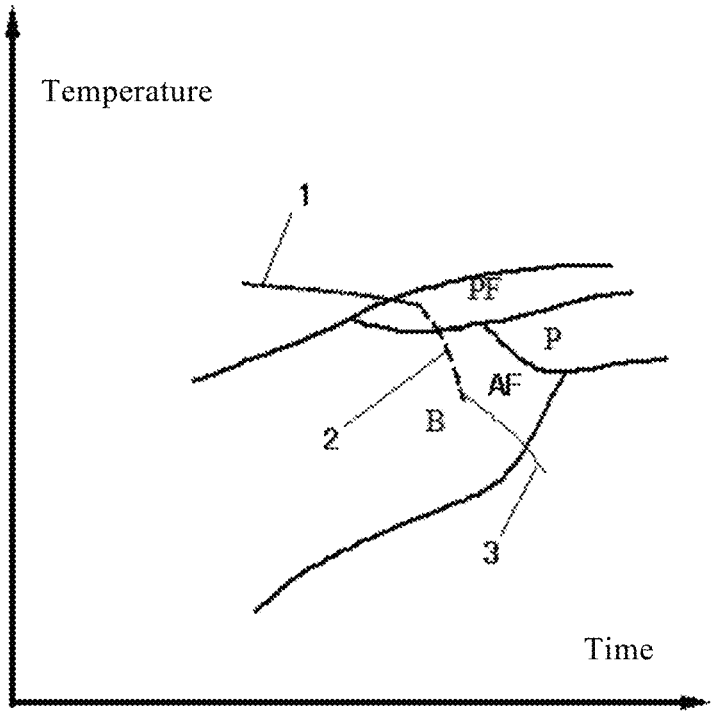
FIG. 1 is a schematic diagram of the delayed rate-varying cooling process in the method for manufacturing the X80 pipeline steel with good strain-aging resistance of the present invention.

X80 line pipes of Examples A1-A6 are manufactured according to the following steps, wherein the contents in percentage by mass of various chemical elements in the X80 line pipes of Examples A1-A6 are as shown in Table 1:

1) Smelting: molten steel is smelted and refined, with the proportions in percentage by mass of various chemical elements in the steel being as shown in Table 1;

2) Casting: a continuous casting method is used, and the ratio of the thickness of the steel slab after the continuous casting to the thickness of the steel plate after the completion of rolling is ≥10;

3) Casting slab heating: the steel slab is reheated at a T Kelvin temperature, $T=7510/(2.96-\log [Nb][C])+30$, wherein [Nb] and [C] respectively represent the contents in percentage by mass of Nb and C; 4) Staged rolling step:

4i) first rolling stage (rough rolling): the start rolling temperature is 960-1150° C., the single pass reductions of at least two passes are ensured to be ≥15% and the thickness of the steel slab in rolling is controlled at $4t_{plate}-0.4t_{slab}$, wherein $t_{plate}$ represents the thickness of the steel plate after the completion of the rolling step, and $t_{slab}$ represents the thickness of the steel slab after the continuous casting;

4i) second rolling stage (finishing rolling): the start rolling temperature is 740-840° C., the single pass reductions of at least two passes are ensured to be ≥20%, and the finish rolling temperature is Ar3 to Ar3+40° C.;

5) Delayed rate-varying cooling: the steel plate after the completion of the rolling is first air-cooled and hold for 60-100 s to reach 700-730° C. so that ferrite is precipitated at a phase proportion of 25-40%, and after the precipitation of the ferrite at a phase proportion of 25-40%, the steel plate is water-cooled rapidly to 550-580° C. at a cooling rate of 25-40° C./s, and then further water-cooled slowly at a cooling rate of 18-22° C. %, with the final cooling temperature being 320-400° C.; FIG. 1 shows the schematic diagram of the delayed rate-varying cooling process, and it can be seen from FIG. 1 that after the completion of the rolling of the steel plate, the steel plate undergoes air-cooling and temperature-holding phase 1, rapid water-cooling phase 2 and slow water-cooling phase 3 of different cooling rates.

6) Pipe making: the O-moulding compression ratio is controlled at 0.15-0.3%, and the E-moulding diameter expansion ratio is controlled at 0.8-1.2%.

For the specific process parameters involved in the various steps of the above-mentioned manufacturing method in detail, reference can be made to Table 2.

Table 1 lists the contents in percentage by mass of the various chemical elements for making the pipeline steels of Examples A1-A6.

TABLE 1

(wt. %, the balance being Fe and inevitable impurities other than N, P and S)

| Serial number | C | Mn | Ni | Ti | Nb | Si | Al | Ca | N | P | S | Cr | PF* (%) |
|---|---|---|---|---|---|---|---|---|---|---|---|---|---|
| A1 | 0.030 | 1.70 | 0.60 | 0.017 | 0.08 | 0.30 | 0.033 | 0.0019 | 0.006 | 0.008 | 0.002 | 0.30 | 30 |
| A2 | 0.040 | 1.65 | 0.49 | 0.014 | 0.075 | 0.30 | 0.030 | 0.0013 | 0.005 | 0.010 | 0.003 | 0.30 | 33 |
| A3 | 0.045 | 1.68 | 0.50 | 0.009 | 0.06 | 0.25 | 0.030 | 0.0022 | 0.004 | 0.009 | 0.005 | 0.25 | 35 |
| A4 | 0.045 | 1.50 | 0.45 | 0.012 | 0.06 | 0.20 | 0.025 | 0.0020 | 0.004 | 0.009 | 0.002 | 0.10 | 34 |
| A5 | 0.045 | 1.40 | 0.40 | 0.011 | 0.06 | 0.20 | 0.030 | 0.0027 | 0.004 | 0.008 | 0.003 | 0.20 | 36 |
| A6 | 0.050 | 1.35 | 0.35 | 0.008 | 0.06 | 0.15 | 0.020 | 0.0025 | 0.003 | 0.006 | 0.003 | 0.15 | 40 |

*Note:
PF (%) is the phase proportion of a polygonal ferrite in a microstructure.

Table 2 lists the process parameters of the method for manufacturing the X80 line pipes in Examples A1-A6.

TABLE 2

| | | | | | Staged rolling | | | | | |
|---|---|---|---|---|---|---|---|---|---|---|
| | | | | | First rolling stage | | | | Second rolling stage | |
| Serial number | Steel slab thickness (mm) | Plate thickness (mm) | Casting R* | Reheating Heating temperature T* (K) | Plate thickness after the completion of the first rolling stage ($4t_{plate} - 0.4t_{slab}$) | Start rolling temperature (° C.) | Rolling pass | Single pass reductions of two larger passes in multiple passes (%) | Start rolling temperature (° C.) | Rolling pass |
| A1 | 250 | 17.5 | 14.3 | 1376 | 87 | 1060 | 7 | 17, 15 | 830 | 15 |
| A2 | 300 | 22 | 13.6 | 1400 | 110 | 1080 | 7 | 16, 15 | 800 | 13 |
| A3 | 300 | 28.6 | 10.5 | 1388 | 120 | 1055 | 5 | 15, 15 | 770 | 9 |
| A4 | 300 | 25.4 | 11.8 | 1388 | 120 | 1063 | 5 | 15, 15 | 780 | 11 |
| A5 | 300 | 22 | 13.6 | 1388 | 110 | 1042 | 7 | 16, 15 | 800 | 13 |
| A6 | 300 | 21 | 14.3 | 1400 | 105 | 1026 | 7 | 16, 15 | 800 | 13 |

| | Staged rolling Second rolling stage | | Delayed rate-varying cooling | | | | | | | |
|---|---|---|---|---|---|---|---|---|---|---|
| | | | | | Temperature | | | | Pipe making | |
| Serial number | Single pass reductions of two larger passes in multiple passes (%) | Finish rolling temperature (° C.) | Air cooling time (s) | Holding temperature (° C.) | after rapid water cooling (° C.) | Rapid water cooling rate (° C./s) | Slow cooling rate (° C./s) | Final cooling temperature (° C.) | O-moulding compression ratio (%) | E-moulding diameter expansion ratio (%) |
| A1 | 23, 21 | 760 | 60 | 730 | 550 | 40 | 21 | 320 | 0.20 | 1.0 |
| A2 | 22, 20 | 740 | 80 | 700 | 570 | 35 | 21 | 340 | 0.25 | 0.9 |
| A3 | 20, 20 | 730 | 67 | 710 | 550 | 25 | 18 | 360 | 0.30 | 0.9 |
| A4 | 20, 20 | 740 | 100 | 700 | 570 | 27 | 19 | 390 | 0.30 | 0.9 |

TABLE 2-continued

| | | | | | | | | | | |
|---|---|---|---|---|---|---|---|---|---|---|
| A5 | 22, 20 | 740 | 80 | 700 | 580 | 35 | 21 | 360 | 0.25 | 0.9 |
| A6 | 23, 21 | 740 | 73 | 700 | 580 | 37 | 21 | 400 | 0.25 | 1.0 |

*Note:

1) R is the ratio of the thickness of a steel slab after continuous casting to the thickness of the steel plate after the completion of rolling; and 2) Heating temperature T = 7510/(2.96 − log[Nb][C]) + 30, wherein [Nb] and [C] respectively represent the contents in percentage by mass of Nb and C.

The mechanical properties of the above-mentioned X80 line pipes as obtained after testing are shown in Table 3, and Table 3 lists the various mechanical property parameters of the line pipes in Examples A1-A6.

Table 3 lists the various mechanical property parameters of the X80 line pipes in Examples A1-A6.

In conjunction with the contents of Tables 3 and 4, it can be seen that compared with the various mechanical property parameters of the X80 line pipes shown in Table 3, the yield strength and the tensile strength of the X80 line pipes after the aging treatment (e.g., simulated coating at 200° C.) both are increased, the yield ratio is slightly increased, and the uniform elongation is slightly reduced, which can still meet performance requirements for strain-based designs. In addition, when the above-mentioned X80 line pipes undergo a tensile strength test, the tensile curve shape is still dome-like, and no yield platform appears, which also correspondingly indicates that the X80 line pipes in Examples A1-A6 herein have good strain-aging resistance.

TABLE 3

| Serial number | Transversal yield strength Rt0.5 (MPa) | Transversal tensile strength Rm (MPa) | Transversal yield ratio Y/T | Longitudinal yield strength Rt0.5 (MPa) | Longitudinal tensile strength Rm (MPa) | Longitudinal yield ratio Y/T | Uniform elongation Uel (%) | Tensile curve shape | Impact work at −45° C. (J) | DWTT at −45° C. SA % |
|---|---|---|---|---|---|---|---|---|---|---|
| A1 | 611 | 712 | 0.86 | 564 | 699 | 0.81 | 7.4 | Doom-shaped | 226 | 100 |
| A2 | 586 | 708 | 0.83 | 550 | 686 | 0.80 | 8.1 | Doom-shaped | 240 | 96 |
| A3 | 575 | 677 | 0.85 | 530 | 670 | 0.79 | 8.2 | Doom-shaped | 200 | 85 |
| A4 | 584 | 684 | 0.85 | 556 | 670 | 0.83 | 7.9 | Doom-shaped | 214 | 87 |
| A5 | 570 | 686 | 0.83 | 540 | 686 | 0.79 | 8.3 | Doom-shaped | 231 | 92 |
| A6 | 579 | 688 | 0.84 | 542 | 673 | 0.81 | 8.1 | Doom-shaped | 241 | 93 |

It can be seen from Table 3 that the X80 line pipes in Examples A1-A6 herein have a higher yield strength and tensile strength, wherein the transversal yield strengths are ≥575 MPa, the transversal tensile strengths are ≥677 MPa, the longitudinal tensile strengths are ≥530 MPa, and the longitudinal tensile strengths are ≥670 MPa. Moreover, the X80 line pipes further have a good low temperature toughness, an impact work at −45° C. reaching 200 J or greater and a uniform elongation Uel reaching 7.4% or greater. In particular, the line pipes in Examples A1-A6 herein further have excellent low temperature fracture toughness resistance and can still meet DWTT performance SA %≥85% at an extremely low temperature of −45° C.

Figure 2:
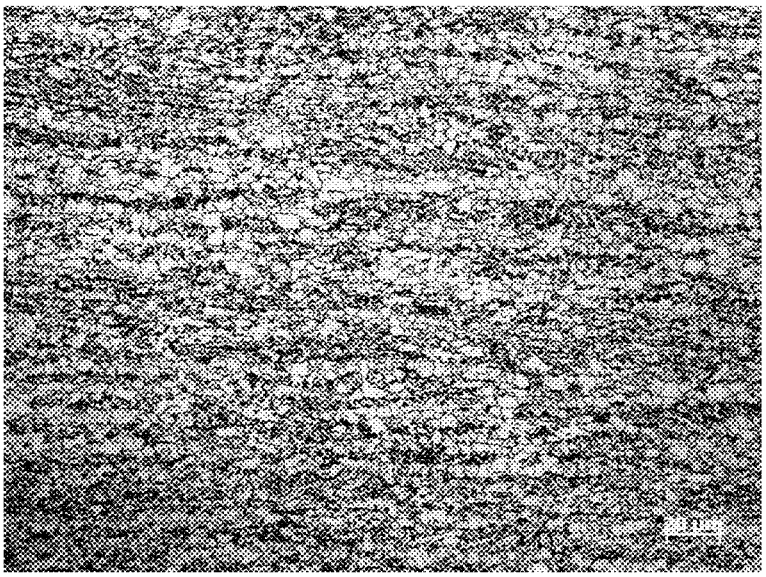
FIG. 2 is a metallographic diagram of the X80 pipeline steel with good strain-aging resistance of the present invention.

FIG. 2 shows the microstructure of the pipeline steel in Example A4, and it can be seen from FIG. 2 that the microstructure of the pipeline steel is a polygonal ferrite (PF)+acicular ferrite (AF)+bainite (B) composite microstructure plate, in which the polygonal ferrite (PF) has a phase proportion of 34%.

An aging test is carried out on the line pipes in Examples A1-A6 under temperature-maintaining conditions of 200° C. for a period of 5 min, to simulate the aging process in anti-corrosion coatings. The mechanical property parameters of the X80 line pipes as obtained after the aging treatment are as shown in Table 4.

It is to be noted that the examples listed above are merely specific examples of the present invention, and obviously the present invention is not limited to the above examples and can have many similar changes. All variations which can be directly derived from or associated with the disclosure of the invention by a person skilled in the art should be within the scope of protection of the present invention.

The invention claimed is:

1. An X80 pipeline steel with a strain-aging resistance, consisting of chemical elements in percentage by mass:

0.02-0.05% of C, 1.30-1.70% of Mn, 0.35-0.60% of Ni, 0.005-0.020% of Ti, 0.06-0.09% of Nb, 0.10-0.30% of Si, 0.01-0.04% of Al, N≤0.008%, P≤0.012%, S≤0.006%, 0.001-0.003% of Ca, Cr≤0.30 wt %, and the balance being Fe and other inevitable impurities, and wherein the microstructure of the steel is polygonal ferrite+ acicular ferrite+ bainite,

TABLE 4

| Serial number | Transversal yield strength Rt0.5 (MPa) | Transversal tensile strength Rm (MPa) | Transversal yield ratio Y/T | Longitudinal yield strength Rt0.5 (MPa) | Longitudinal tensile strength Rm (MPa) | Longitudinal yield ratio Y/T | Uniform elongation Uel (%) | Tensile curve shape | Impact at −45° C. (J) | DWTT at −45° C. SA % |
|---|---|---|---|---|---|---|---|---|---|---|
| A1 | 629 | 715 | 0.88 | 561 | 703 | 0.80 | 6.1 | Doom-shaped | 214 | 100 |
| A2 | 601 | 710 | 0.85 | 559 | 696 | 0.80 | 7.2 | Doom-shaped | 236 | 93 |
| A3 | 589 | 696 | 0.85 | 546 | 683 | 0.80 | 7.6 | Doom-shaped | 211 | 85 |
| A4 | 610 | 695 | 0.88 | 563 | 679 | 0.83 | 6.9 | Doom-shaped | 216 | 89 |
| A5 | 600 | 689 | 0.87 | 560 | 694 | 0.81 | 7.3 | Doom-shaped | 221 | 90 |
| A6 | 608 | 691 | 0.88 | 559 | 690 | 0.81 | 7.1 | Doom-shaped | 223 | 90 |

wherein the phase portion of said polygonal ferrite is 25-40%;

wherein after an aging test being carried out under temperature-maintaining conditions of 200° C. for a period of 5 minutes, the steel has a longitudinal yield strength of 510-630 MPa, a tensile strength of 625-770 MPa, a uniform elongation of ≥6% and a yield ratio of ≤0.85, and the tensile curve of the steel appears as a dome-shaped continuous curve.

2. The X80 pipeline steel of claim 1, wherein a body of said X80 pipeline steel has a circumferential yield strength of 560-650 MPa and a tensile strength of 625-825 MPa.

3. A line pipe made of the X80 pipeline steel of claim 1.

4. A method for manufacturing the X80 pipeline steel of claim 1, comprising the steps of smelting, casting, casting slab heating, staged rolling, delayed rate-varying cooling and pipe making.

5. The method for manufacturing the X80 pipeline steel of claim 4, wherein in said casting step, continuous casting is used, and a ratio b which is defined as the thickness of the steel slab after the continuous casting to the thickness of the steel plate after the completion of the staged rolling is ≥10.

6. The method for manufacturing the X80 pipeline steel of claim 4, wherein in said casting slab heating step, the steel slab is reheated at a T Kelvin temperature, T=7510/(2.96−log [Nb][C])+30, wherein [Nb] and [C] respectively represent the contents in percentage by mass of Nb and C.

7. The method for manufacturing the X80 pipeline steel of claim 4, wherein said staged rolling step comprises a first rolling stage and a second rolling stage, and the steel slab is rolled to a thickness of $4t_{plate}-0.4t_{slab}$ in the first rolling stage, wherein $t_{plate}$ represents the thickness of the steel plate after the completion of the rolling step, and $t_{slab}$ represents the thickness of the steel slab after the continuous casting.

8. The method for manufacturing the X80 pipeline steel of claim 7, wherein the start rolling temperature of said first rolling stage is 960-1150° C., and the start rolling temperature of said second rolling stage is 740-840° C.

9. The method for manufacturing the X80 pipeline steel of claim 7, wherein at least two passes in said first rolling stage have a single pass reduction of ≥15%, and at least two passes in said second rolling stage have a single pass reduction of ≥20%.

10. The method for manufacturing the X80 pipeline steel of claim 7, wherein the finish rolling temperature of said second rolling stage is Ar3 to Ar3+40° C.

11. The method for manufacturing the X80 pipeline steel of claim 4, wherein in said delayed rate-varying cooling step, the steel plate after the completion of the rolling is first air-cooled and hold for 60-100 s to reach 700-730° C., and wherein ferrite at a phase proportion of 25-40% is precipitated.

12. The method for manufacturing the X80 pipeline steel of claim 11, wherein in said delayed rate-varying cooling step, after the precipitation of the ferrite at a phase proportion of 25-40%, the steel plate is water-cooled rapidly to 550-580° C. at a cooling rate of 25-40° C./s, and then further water-cooled slowly at a cooling rate of 18-22° C. %, with the final cooling temperature being 320-400° C.

13. The method for manufacturing the X80 pipeline steel of claim 4, wherein in said pipe making step, the O-moulding compression ratio is controlled at 0.15-0.3%, and the E-moulding diameter expansion ratio is controlled at 0.8-1.2%;

wherein the O-moulding compression ratio=(the width of the steel sheet before moulding−the perimeter of the natural plane after O moulding)/the width of the steel sheet before moulding; and the E-moulding diameter expansion ratio=(the perimeter of the outer diameter of the steel pipe after diameter expansion−the perimeter of the outer diameter of the steel pipe before diameter expansion)/the perimeter of the outer diameter of the steel pipe before diameter expansion.

* * * * *